US008579287B1

(12) United States Patent
Herrmann et al.

(10) Patent No.: US 8,579,287 B1
(45) Date of Patent: Nov. 12, 2013

(54) HIGH SPEED ROTARY NIP DIVERTER

(75) Inventors: Douglas K Herrmann, Webster, NY (US); Alex Talevski, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/600,262

(22) Filed: Aug. 31, 2012

(51) Int. Cl.
*B65H 39/10* (2006.01)

(52) U.S. Cl.
USPC ..... 271/302; 271/303; 271/301

(58) Field of Classification Search
USPC ..... 271/301–303
See application file for complete search history.

(56) References Cited

U.S. PATENT DOCUMENTS

| | | | | |
|---|---|---|---|---|
| 4,431,322 | A * | 2/1984 | Nally et al. | 400/605 |
| 5,201,517 | A | 4/1993 | Stemmle | |
| 5,210,616 | A * | 5/1993 | Kawasaki et al. | 358/296 |
| 5,428,431 | A | 6/1995 | Abe et al. | |
| 6,186,501 | B1 * | 2/2001 | St. Ours | 271/302 |

FOREIGN PATENT DOCUMENTS

| | | | |
|---|---|---|---|
| GB | 2073153 | A * | 10/1981 |
| JP | 04148763 | A * | 5/1992 |

* cited by examiner

*Primary Examiner* — Luis A Gonzalez

(57) ABSTRACT

A media velocity decoupling device is part of a rotary nip diverter assembly and includes a one-way clutch connected to a drive roller of a rotary nip diverter gate. The one-way clutched drive roller allows for realignment of the rotary nip diverter gate during media transfer to a downstream nip while the media is captured in both the rotary nip diverter gate and the downstream nip without media slippage or stretching occurring.

10 Claims, 3 Drawing Sheets

HIGH SPEED ROTARY NIP DIVERTER

This invention relates generally to a rotary nip diverter device, and more particularly, to a velocity decoupling device incorporated within the rotary nip diverter device for high speed diverting of media or sheets away from a sheet transport path into one of multiple downstream paths.

BACKGROUND

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules to the latent image forming a toner powder image on the photoconductive member. The toner powder image is then transferred from the photoconductive member to a copy sheet. The toner particles are heated to permanently affix the powder image to the copy sheet.

SUMMARY

In printing machines such as those described above, it is necessary to mechanically divert media from an input baffle to one or more downstream baffles, for example, when media needs to be inverted, and traditional diverter gates must be actuated in the inter-copy gap between the incoming media. However as the speeds of the media increase and the inter-copy distances/times are reduced, the time available during the inter-copy gaps is becoming less than can be achieved by these traditional diverter gates.

More specifically, as speeds and throughput requirements are increased the inter-copy gap spacing and timing are reduced. Traditional diverter gate assemblies rely on this inter-copy gap to actuate. The gate cannot be actuated prior to the trail edge (TE) of the previous sheet having cleared the gate and the gate must complete its actuation prior to the arrival of the lead edge (LE) of the following sheet.

The reaction times of the diverter assemblies are limited by the electro-mechanical actuation devices, such as, solenoids or stepper driven gates and their ability to actuate during the inter-copy gap timing. For example, a system running at approx. 1000 mm/s with a 40 mm inter-copy gap only allows for 40 ms of actuation time, trail edge to lead edge (TE to LE). That is, as that inter-copy distance is reduced or the media velocity is increased, the actuation time allowed during the inter-copy gap becomes very short.

An answer to this problem is the ability to have a rotary nip diverter mechanism that can be actuated to direct the sheet to the selected downstream nip prior to the inter-copy gap—while the sheet is within the nip. This changes the nip actuation from the short timing of the inter-copy gap to the much longer timing available when the media is captured in the rotary nip diverter gate. For example, at the same 1000 mm/s with an 8.5"×11" sheet, the system has approximately 320 ms of divert timing (LE to LE) compared to the 40 ms of inter-copy gap timing (TE to LE). However, an issue with rotating the diverter nip while the sheet is in the nip is caused by the sheet being simultaneously held in a downstream nip. The rotation of the diverter nip will, by design, create a tension in the sheet that could cause unwanted stretch or slip.

U.S. Pat. No. 5,201,517 shows how an orbiting nip is used to guide a sheet's leading edge held in a nip to a different direction only. It does not provide for the nip to pivot when the lead edge of that sheet is held by a downstream nip. It also does not provide a solution to the inter-copy gap problem presented by a shortened inter-copy gap time created by the faster speeds needed to meet the higher throughput requirements.

Thus, a need still exists for an apparatus that overcomes this problem of velocity mismatch.

Accordingly, a rotary nip diverter assembly is disclosed that provides decoupling that is required to allow a rotary nip to be actuated while media is controlled by both the rotary nip of the rotary nip diverter assembly and a downstream nip of a selected baffle. The rotary nip diverter assembly employs a rotary nip diverter gate roll and a one-way clutch within the rotary nip diverter gate roll to provide decoupling of the rotary nip diverter gate roll from the downstream nip drive. By including the decoupling function in the rotary nip drive itself, the diverter action can be completed while the media is within the nip rather than solely having to occur during the inter-copy gap.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION

Figure 1:
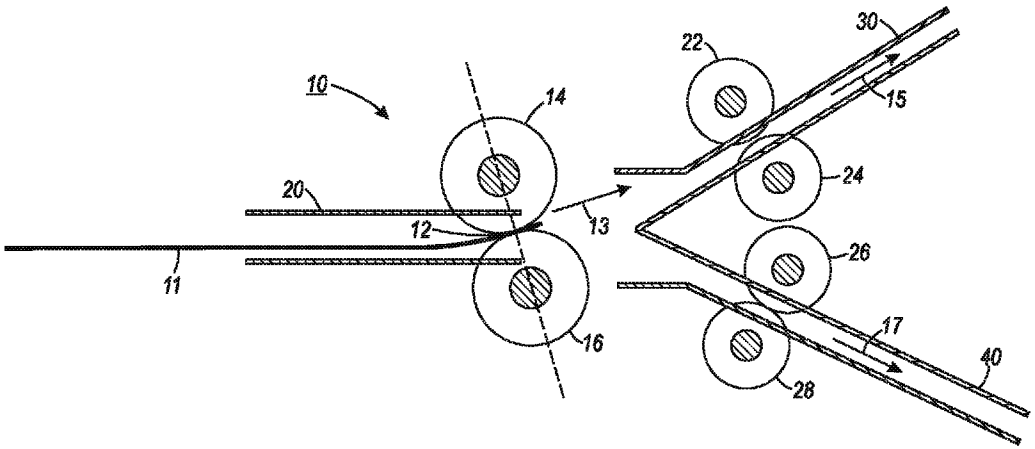
FIG. 1 is a frontal view of the rotary nip diverter gate of the present disclosure showing it in a first position.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment within a xerographic printing apparatus that includes a method and apparatus for decoupling velocities between a rotary nip of a diverter and a nip in downstream baffles.

For a general understanding of the features of the disclosure, reference is made to the drawings. In the drawings, like reference numerals have been used throughout to identify identical elements.

Referring now to rotary nip diverter assembly 10 in FIG. 1, and in accordance with the present disclosure, it includes a velocity decoupling device as a part of the rotary nip diverter assembly 10 that allows for the needed drive of media through the rotary nip diverter assembly and balances that drive with the added function of allowing for the decoupling of any velocity mismatch created by the rotation of the diverter mechanism. The decoupling device comprises a conventional one-way clutch (for example, a drawn cup roller clutch sold by The TIMKIN Company, Canton, Ohio) (not shown) that is installed within drive roller 16 with the drive roller in turn installed over a conventional drive shaft. This drive shaft is rotated in a conventional manner and as the shaft turns the one-way clutch will lock to the shaft to create drive to roller 16. When a sheet being driven by the rotary gate drive roller nip is pulled at a higher velocity by a downstream nip, rotary nip roller 16 is free to rotate faster than the rotary nip drive shaft is turning. The one-way clutch allows for free movement at any velocity above the angular velocity of the shaft. A suitable one-way clutch is also shown in U.S. Pat. No. 5,428,431 and incorporated herein by reference. An idler roller 14 forms a rotary drive nip gate 12 with drive roller 16 and drives sheets or media 11 in the direction of arrow 13 between baffle assembly 20 and into either baffle assembly 30 and into a nip formed between drive roller 24 and idler roller 22 in the direction of arrow 15 or in the direction of arrow 17 and into baffle assembly 40 for capture by a nip formed between idler roller 26 and drive roller 28 depending upon positioning of rotary nip gate 12 of rotary nip diverter assembly 10.

In addition, the one-way clutch can have frictional loading to maintain a pre-determined level of tension in the sheet.

Figure 2:
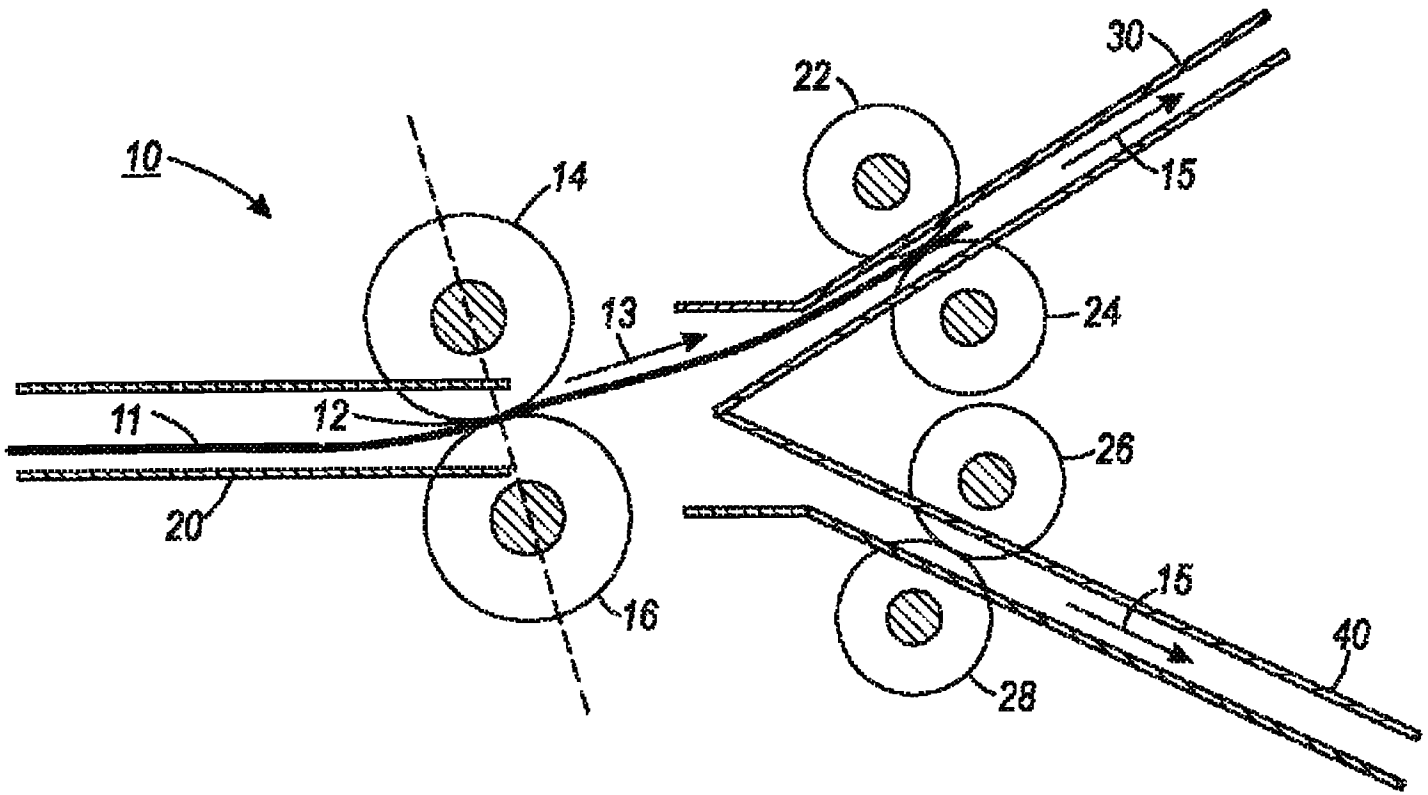
FIG. 2 is a frontal view showing the rotary nip diverter gate in the first position of FIG. 1 with media under control of both the rotary nip diverter gate and a downstream exit nip in an exit baffle.
Figure 3:
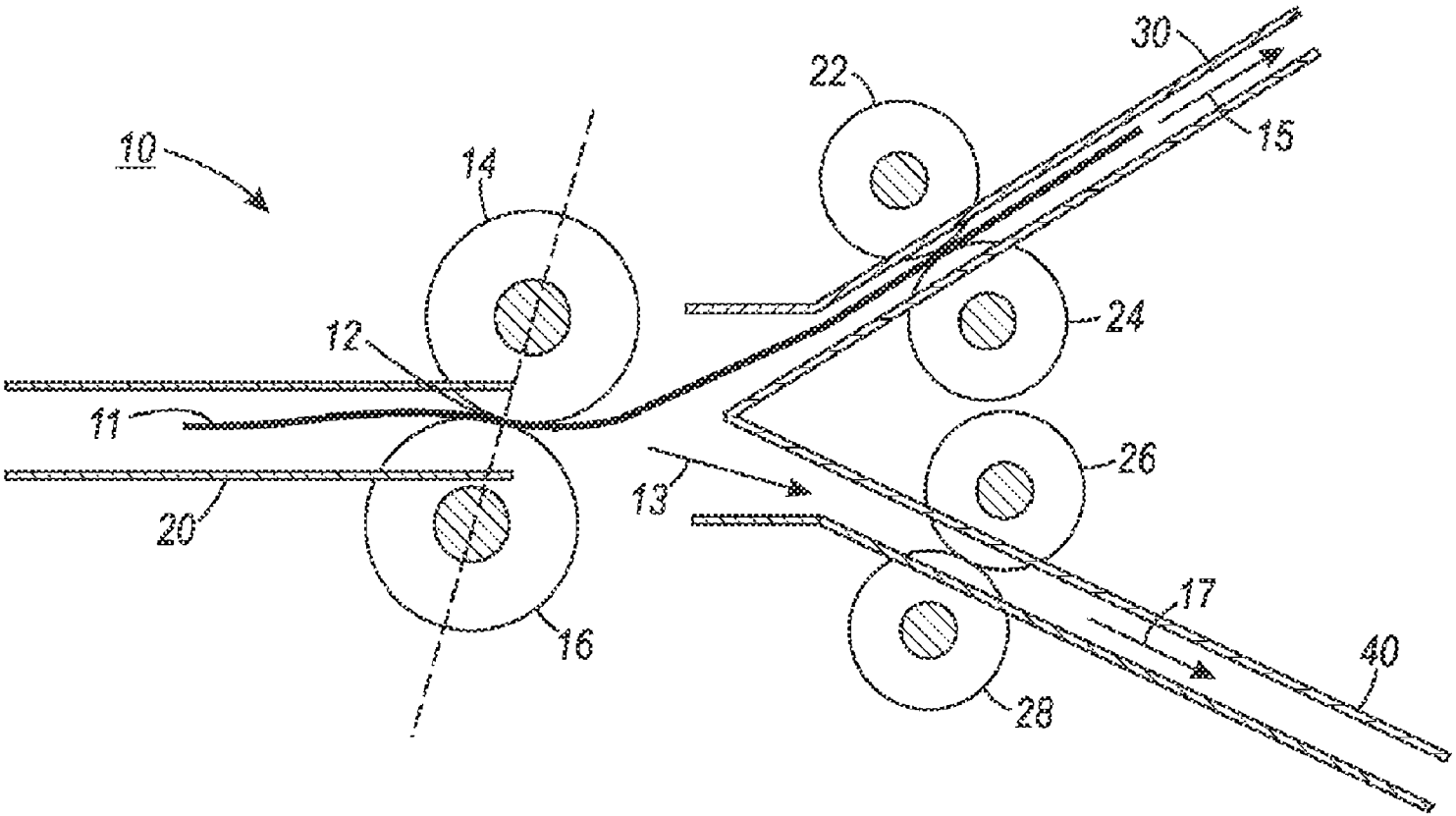
FIG. 3 is a frontal view of the rotary nip diverter gate of FIG. 2 showing the rotary nip diverter gate in a second position with media under control of both the rotary nip diverter gate and the downstream exit nip in the exit baffle.

In FIG. 1, rotary nip diverter gate 12 of rotary nip diverter assembly 10 is shown rotated to drive media into exit baffle assembly 30, while in FIG. 2 the rotary nip diverter gate 12 is shown pivoted with media 11 under control of both the rotary nip diverter gate 12 and a downstream nip formed between idler roller 22 and drive roller 24 within exit baffle assembly 30. Rotary nip diverter gate 12 is shown pivoted in FIG. 3 to direct media to downstream nips in exit baffle 40 while media is still within the rotary nip, thereby allowing for the previous media to complete handoff to exit baffle 30 nip. This completes a divert motion using sheet timing in addition to inter-copy gap spacing while allowing for the diverter to be actuated while sheet is simultaneously in the diverter and a downstream nip allowing for higher media speeds and overcoming limitations of traditional diverter actuators functioning only in the inter-copy gaps.

In recapitulation, a rotary nip diverter system with an integrated velocity decoupling device is disclosed as a part of a roller nip assembly. The integrated velocity decoupling device facilitates the performance of a velocity decoupling within the rotary nip diverter system, thereby enabling the rotary nip diverter to be actuated while media is held simultaneously within the nip diverter system and a downstream nip. The use of a one way clutch provides the lock and pivoting direction for the media within the diverter system. The result is that this system would enable the subsequent sheet to be accurately directed to the appropriate baffle prior to the inter-copy gap of the trail edge of the current sheet in the diverter. In addition, the use of a one-way clutch allows for the diverter to be actuated while a sheet is simultaneously within the diverter and a downstream nip allowing for higher media speeds and overcoming limitations of traditional diverter actuators functioning only in the inter-copy gaps. It can also eliminate the need for a nip release mechanism in diverter baffle designs and eliminates the need to incorporate an active control system to manage the velocity mismatch due to the gate motion and downstream nip.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for providing media velocity control within a rotary nip diverter system, comprising:

providing a roller nip assembly;

providing a rotary nip diverter as part of said roller nip assembly that is pivotable between multiple positions; and pivoting said rotary nip diverter between each of said multiple positions while media is held simultaneously within said rotary nip diverter and a downstream nip without causing tension in said media.

2. The method of claim 1, including providing said rotary nip diverter with a one-way clutch.

3. The method of claim 2, including providing said rotary nip diverter with an idler roller and a drive roller, said drive roller being mounted with respect to said idler roller so as to form said rotary nip diverter, and wherein said one-way clutch is connected to said drive roller.

4. The method of claim 3, including providing said one-way clutch as an integral part of said drive roller.

5. The method of claim 3, including mounting said drive roller on a first shaft and said idler roller on a second shaft.

6. The method of claim 5, including mounting said drive roller and said one-way clutch on said first shaft.

7. The method of claim 3, including realigning said rotary nip diverter during media transfer to said downstream nip while said media is captured in both said rotary nip diverter and said downstream nip and while rotating said idler roller and said drive roller in unison.

8. The method of claim 2, including using said one-way clutch to enable subsequent media to be directed to a predetermined baffle assembly prior to the inter-copy gap of a trail edge of current media leaving said rotary nip diverter.

9. The method of claim 8, including pivoting said rotary nip diverter to drive media into a second baffle assembly.

10. The method of claim 1, including pivoting said rotary nip diverter into at least two positions to drive media into at least two downstream sheet paths.

* * * * *